United States Patent [19]

Tooka

[11] 4,006,864

[45] Feb. 8, 1977

[54] METHOD AND APPARATUS FOR CARRYING OUT DOFFING AND DONNING OPERATION

[75] Inventor: Takuzo Tooka, Toyoake, Japan

[73] Assignees: Daiwa Boseki Kabushiki Kaisha, Osaka; Kabushiki Kaisha Toyoda Jidoshokki Seisakusho, both of Japan

[22] Filed: Nov. 21, 1974

[21] Appl. No.: 525,848

[30] Foreign Application Priority Data

Nov. 27, 1973 Japan ..... 48-133770
Nov. 27, 1973 Japan ..... 48-133771

[52] U.S. Cl. ..... 242/35.5 R; 57/34 R; 242/35.5 A

[51] Int. Cl.[2] ..... B65H 67/04

[58] Field of Search ..... 242/35.5 R, 35.5 A, 242/35.6 R, 35.6 E; 57/53, 34 R; 15/312 R

[56] References Cited

UNITED STATES PATENTS

| | | | |
|---|---|---|---|
| 3,018,503 | 1/1962 | Hijiya et al. | 15/312 R |
| 3,791,126 | 2/1974 | Kose et al. | 242/35.5 A UX |
| 3,801,030 | 4/1974 | Kobatake et al. | 242/35.5 A X |
| 3,820,730 | 6/1974 | Endo et al. | 242/35.5 A X |
| 3,842,580 | 10/1974 | Franzen | 242/35.5 R X |

*Primary Examiner*—Stanley N. Gilreath
*Attorney, Agent, or Firm*—Burgess Ryan and Wayne

[57] ABSTRACT

An improved method and apparatus for carrying out the doffing and donning operation of a spinning machine such as an open-end spinning machine. A suction nozzle is carried along the lengthwise direction of the spinning machine at a position before and above the take-up mechanisms of the spinning machine at the time of carrying out the doffing and donning operation. The suction nozzle is capable of holding a leading end portion of a yarn delivered from each spinning unit and this leading end portion of the yarn is caught by a fresh bobbin before the bobbin is mounted on a cradle of the take-up mechanism from outside the spinning machine and, then, the bobbin is mounted on the cradle and the take-up operation is commenced. The suction nozzle is capable of being stopped at any position along the passage thereof by manual operation.

3 Claims, 14 Drawing Figures

A
B
1
2
3
4
5
6
7
8
9
10
12
13
15
19
20

METHOD AND APPARATUS FOR CARRYING OUT DOFFING AND DONNING OPERATION

SUMMARY OF THE INVENTION

The present invention relates to an improved method and apparatus for carrying out the doffing and donning operation of a spinning machine, such as an open-end spinning machine.

It is well known that, in the spinning operation wherein an open-end spinning machine is utilized, when the size of yarn packages formed by the respective taking up mechanisms attains a predetermined full size, such full size yarn packages are doffed from the respective taking-up mechanisms while the yarn extending between the full yarn package and the delivery part of the spinning unit is severed at a portion adjacent to the yarn package of each spinning unit. Thereafter, a leading and of the yarn from the spinning unit is held by a corresponding suction means and, next, the leading and of delivery yarn is manually or mechanically caught by a fresh bobbin. Thereafter, the fresh bobbin is positioned on a cradle of each taking up mechanism so as to start the formation of a new yarn package about the fresh bobbin. According to our experience in mill operations, the above-mentioned method for doffing and donning full size packages from the respective take-up mechanisms involves several drawbacks. That is, for example, it is necessary to utilize a suction means for each spinning unit so as to hold a leading end of yarn delivered from the corresponding spinning unit. Therefore, the cost for adopting these suction means is high because of the high installation cost. Further, these suction means need a large amount of suction air for carrying out the doffing and donning operation. Moreover, since there are provided numerous overhead suction means disposed along the lengthwise direction of the open-end spinning machine at the position above an alignment of the take-up means, these suction means make it difficult to provide good lighting for the take-up mechanism.

The principal object of the present invention is to provide an improved method and apparatus for carrying out the doffing and donning operation of a spinning machine, particularly an open-end spinning machine.

In the improved method of the present invention for carrying out the doffing and donning operation of a spinning machine, a suction means for holding a leading end of yarn delivered from a spinning unit is displaced along the longitudinal direction of the spinning machine and a suction nozzle extends to a position right above the floor of the spinning mill. In this embodiment of the present invention, a main suction duct is disposed along the longitudinal direction of the spinning machine at a position above the spinning machine and a movable suction nozzle is displaceably connected to the main suction duct so that the suction nozzle is capable of displacing along the longitudinal direction of the spinning machine when the doffing and donning operation of the spinning machine is carried out. In a modified apparatus of the present invention, the above-mentioned suction nozzle is capable of stopping at any position along the longitudinal direction of the spinning machine. Therefore, the above-mentioned drawbacks of the conventional suction means utilized for carrying out the doffing and donning operation of the spinning machine can be eliminated perfectly according to to the present invention.

DETAILED EXPLANATION OF THE INVENTION

Figure 1A:
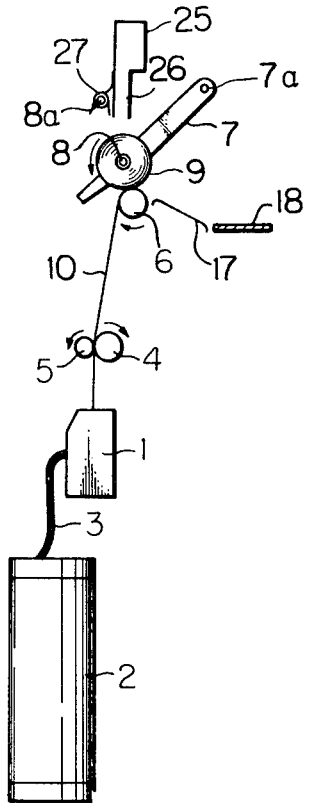
Fig. 1A PRIOR ART
FIGS. 1A, 1B, 1C and 1D are schematic side views of a conventional doffing and donning apparatus, showing steps of a doffing and donning operation.

For the sake of easy understanding of the characteristic feature of the present invention, the doffing and donning operation carried out by a conventional apparatus, which was disclosed in a copending patent application, Ser. No. 460,086, filed on Apr. 11, 1974, now Pat. No. 3,940,076 is firstly explained.

Referring to FIGS. 1A, 1B, 1C and 1D, wherein steps of the doffing and donning operations of the above-mentioned conventional apparatus are shown, a sliver 3 contained in a can 2 is supplied to an open-end spinning unit 1 and a yarn 10 is delivered from the spinning unit 1 by means of a take-up force created by delivery rollers 4 and 5, wherein the roller 4 is positively driven by a driving mechanism (not shown) while the roller 5 rotatably contacts the roller 4. Then the yarn 10 is wound on a bobbin 8 by a take-up mechanism comprising a friction roller 6 and a bobbin holding cradle 7 which is turnably mounted on a pivot shaft *7a* in such a condition that the bobbin 8 is capable of contacting the friction roller 6. In this take-up mechanism, the friction roller 6 is a split drum which is positively driven by a driving mechanism (not shown) and provided with a yarn guide groove for traversing the yarn passage along the longitudinal axis of the bobbin. The size of a yarn package formed on the bobbin 8 is increased, until a full yarn package 9 is formed, by take-up of the yarn 10 according to the rotation of the yarn package formed on the bobbin 8. This rotation is created by the frictional contact of the yarn package with the split drum 6. Then, the full yarn package 9 is doffed from the above-mentioned winding mechanism and displaced to a conveyer belt 18 disposed along the lengthwise direction of the open-end spinning machine at a position adjacent to the winding mechanisms of the spinning machine.

Since the construction of the cradle 7 is disclosed in the above-mentioned copending application, the detailed explanation thereof is omitted. The cradle 7 is capable of turning upward from the split drum 6. A suction duct 25 is disposed above the take-up mechanism and a suction nozzle 26 connected to the suction duct 25 is disposed at the upper position of the cradle 7 right above each take-up mechanism. Consequently, after doffing a full yarn package 9 from the bobbin catchers (not shown) of the cradle 7, when the yarn 10 carried from the delivery rollers 4 and 5 is sucked into the suction nozzle 26, the yarn passes beyond the surface of the split drum 6 on the side where the yarn package contacts the split drum 6. A bobbin holder 27 is mounted to the bottom outside of the suction nozzle 26 so as to detachably hold the fresh bobbin 8*a* in such a condition, that, when the bobbin holding cradle 7 is turned toward the suction nozzle 26, the bobbin holding means (not shown) mounted on the cradle 7 arrives at the position of the bobbin holder 27 and a fresh bobbin 8*a* is transferred from the bobbin holder 27 to the bobbin holding means of the cradle 7 automatically.

After this the fresh bobbin 8*a* is taken from the bobbin holder 27 by the turning of the cradle 7 toward the split drum 6. In this embodiment, it is further essential to dispose the bobbin holder 27 at a position on the suction nozzle 26 which is opposite the side just above the yarn passage over the split drum 6 and the conveyer 18 (FIGS. 1A through 1D) when the yarn end is sucked into the suction nozzle 26, A guide plate 17 is disposed between the split drum 6 and the conveyer 18 so as to guide a full yarn package 9 to the conveyer 18.

Figure 1B:
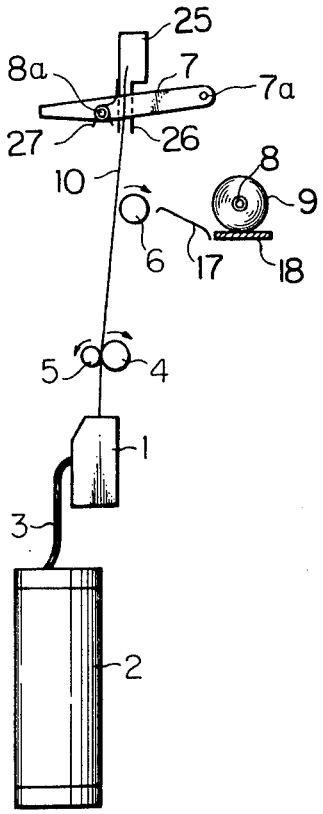
Fig. 1B PRIOR ART

A fresh bobbin 8*a* is inserted into each bobbin holder 27 of each spinning unit, before commencing the doffing operation as shown in FIG. 1A. When a full yarn package 9 has been formed on a bobbin 8, the doffing operation is commenced. An operator cuts the yarn 10 at a position between the delivery rollers 4, 5 and the take-up roller 6. The above-mentioned cutting operation is carried out manually or by using a suitable cutting apparatus. The yarn portion connected to the yarn package 9 is wound around the yarn package 9 and, if the above-mentioned operation is carried out manually, the end of the yarn connected to the yarn delivered from the delivery rollers 4 and 5 is held in the hand of the operator. Then after doffing the full yarn package 9 from the cradle 7, the cradle 7 is turned toward the suction nozzle 25 manually. (FIG. 1B)

During the above-mentioned upward turning motion of the cradle 7, the full yarn package 9 rolls along a slope formed on the guide plate 17 toward the conveyer belt 18 and rests on the conveyer belt 18, and as the yarn 10 is continuously being delivered from the delivery rollers 4 and 5, the delivered yarn is carried to the suction nozzle 26 so as to be continuously sucked thereinto. (FIG. 1B)

When the cradle 7 is turned to the terminal position of its upward turning motion, the bobbin catchers (not shown) of the cradle 7 hold a fresh bobbin 8*a*, which is also being held by the bobbin holder 27 as already illustrated, while the yarn continuously being delivered from the delivery rollers 4 and 5 is continuously sucked into the suction nozzle 25 from a yarn passage passing before the take-up roller 6.

Figure 1C:
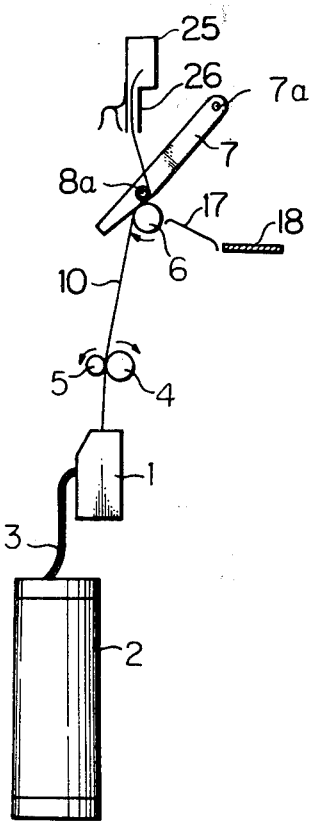
Fig. 1C PRIOR ART
Figure 1D:
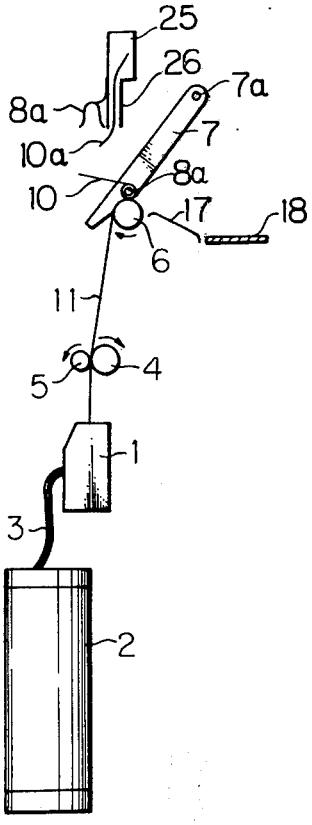
Fig. 1D PRIOR ART

In the above-mentioned condition, the conveyer belt 18 carries the full yarn package 9 outside the open-end spinning machine. After that the yarn is urged against the split drum 6 by the downward turning motion of the fresh bobbin 8*a*, which is turnably held by the bobbin catchers (not shown) of the cradle 7, and nipped by the fresh bobbin 8*a* and the split drum 6. (FIG. 1C)

Next, when the yarn 10 between the suction nozzle 26 and the fresh bobbin 8*a* is cut manually or by a suitable cutting device (not shown) into two portions, wherein an upper portion is extending from the suction nozzle 26, while the other portion is extending from the fresh bobbin 8*a*. And the upper yarn portion of the yarn is sucked into the suction nozzle 26, while the other portion of the yarn falls on the fresh bobbin 8*a* so that this yarn portion is wound on the bobbin 8*a* due to the rotation of the bobbin 8*a*. (FIG. 1D) As the yarn portion is wound on the fresh bobbin 8*a* is mentioned above, the winding operation on the bobbin 8*a* can be commenced.

The above-mentioned method and apparatus for carrying out the doffing and donning operation of an open-end spinning machine involves problems which need to be solved, as pointed in the above Summary of the Invention. Therefore, in the apparatus according to the present invention, particular effort has been directed to elimination of the above-mentioned drawbacks of the conventional apparatus mentioned above.

Referring to FIGS. 2A, 2B, 2C, 2D, 3 and 4, in the apparatus according to the present invention, a suction duct 11 is disposed along a longitudinal direction of a spinning machine A at a position above an Aligned raw of take-up mechanisms of spinning units, and the suction duct 11 is connected to a suction blower 19 (FIG. 3) mounted on a gear and frame B. The suction duct 11 is provided with a horizontal aperture (not shown) extending along the lengthwise direction of the spinning machine A and covered with a flexible plate 11*a*. A suction nozzle 12 is displaceably engaged into the horizontal aperture in such a way that the flexible plate 11*a* allows displacements of a connecting pipe 12*a* of the suction nozzle 12, but always closes the remaining portion of the horizontal aperture beside the engaging part of the aperture with the portion 12*a*. Consequently, air is sucked into the suction nozzle 12 from a mouth thereof after being sucked through the suction duct 11, due to the engagement of the horizontal aperture with the connecting pipe 12*a* of the suction nozzle 12. The detailed construction and function of the above-mentioned suction means comprising the suction duct 11 and the suction nozzle 12 is disclosed in detail in the copending patent application Ser. No. 460,086 filed on Apr. 11, 1974. However, the gist of the construction and function of the above-mentioned suction means utilized for the apparatus of the present invention is hereinafter illustrated.

Figure 3:
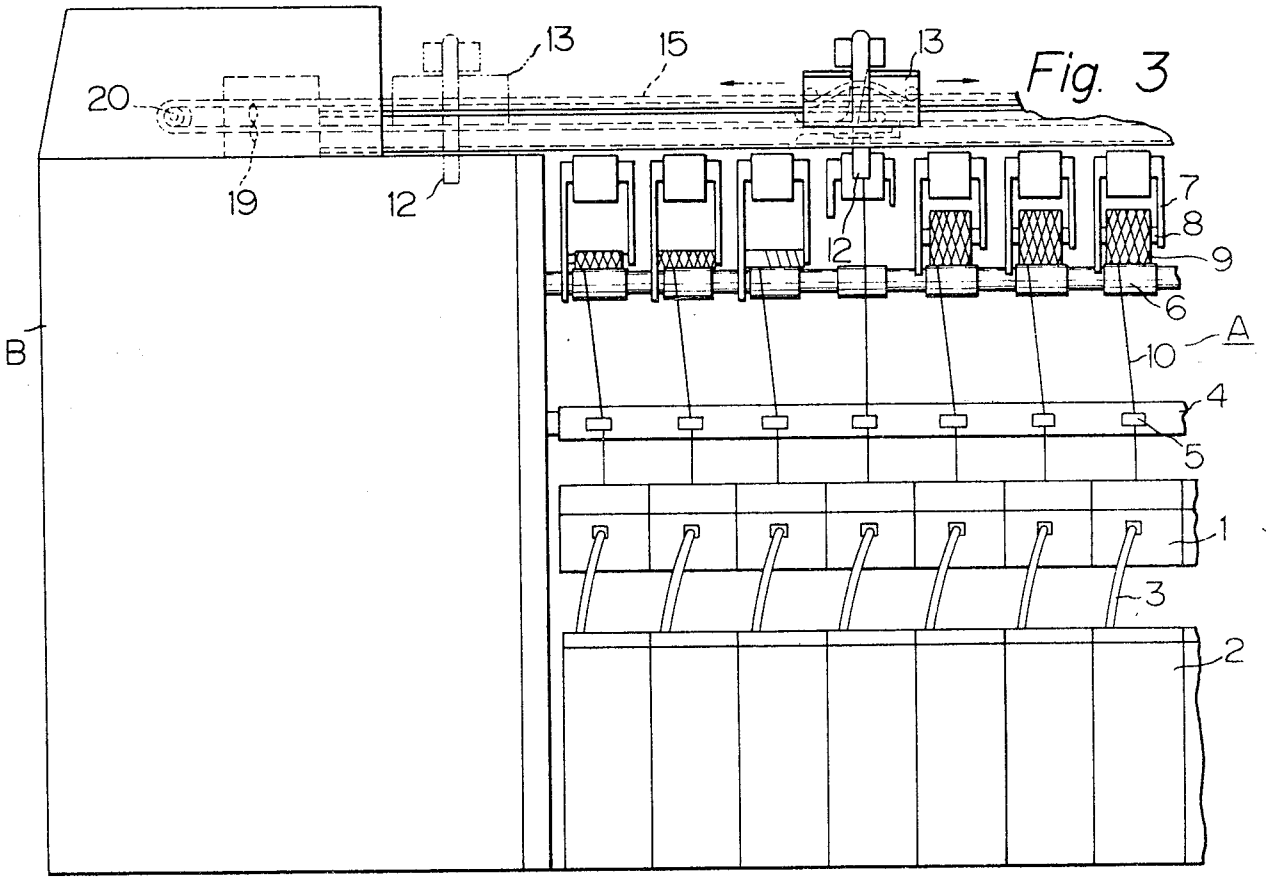
FIG. 3 is a schematic front view of an open-end spinning machine equipped with a suction means utilized for the doffing and donning apparatus according to the present invention.
Figure 4:
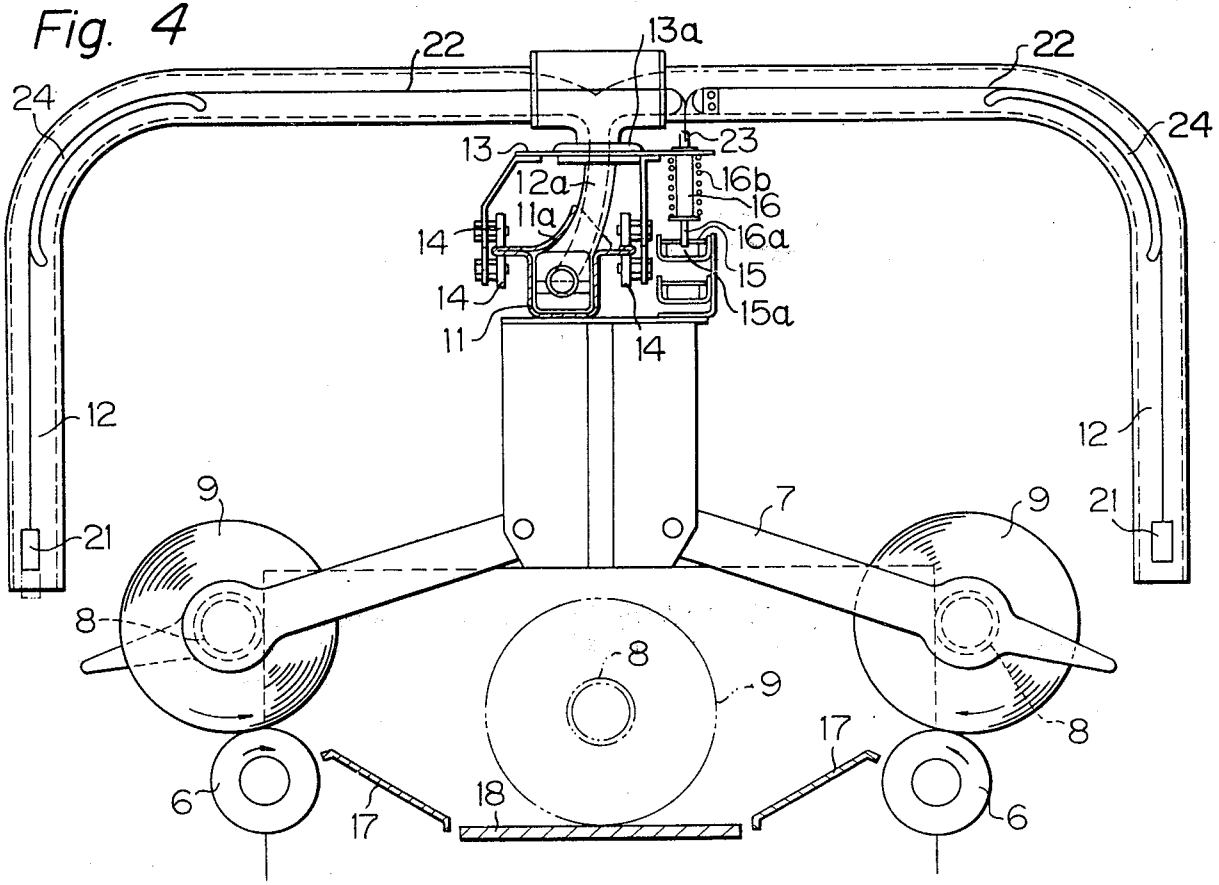
FIG. 4 is a side view of the suction means, and related parts of the doffing and donning apparatus shown in FIG. 3.
Figure 7:
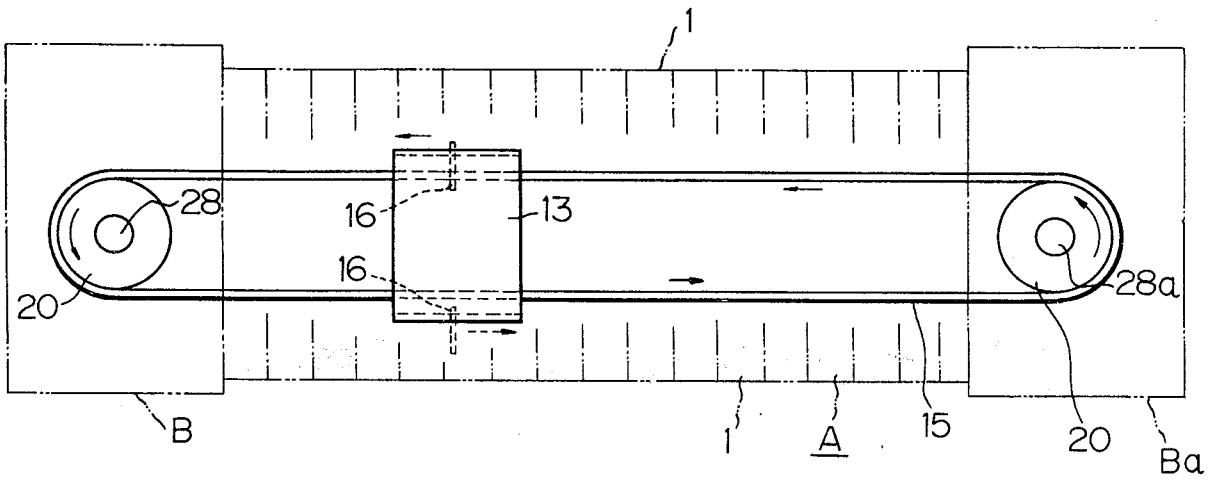
FIG. 7 is an explanatory plan view of a modified suction means according to the present invention.
Figure 8:
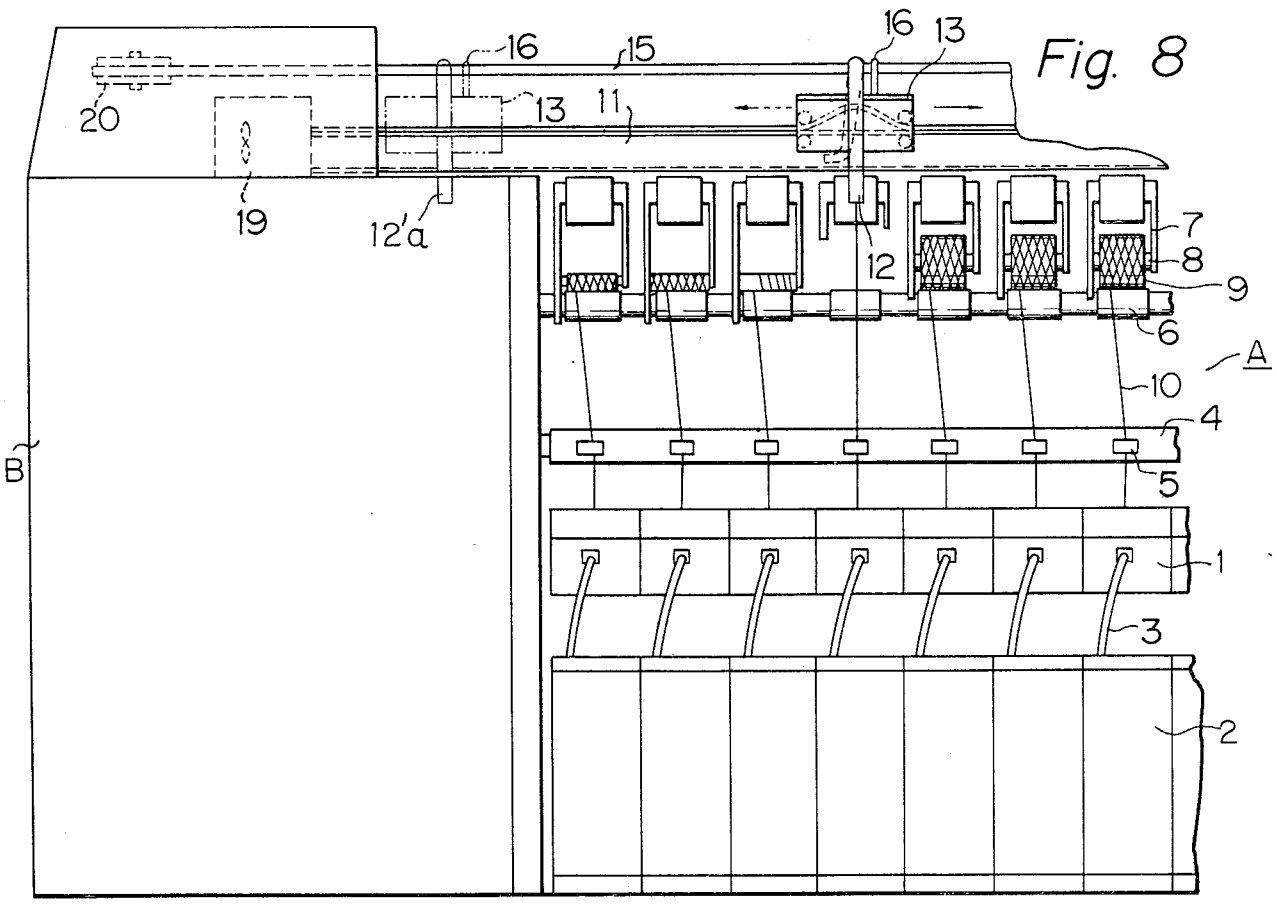
FIG. 8 is a schematic front view of an open-end spinning machine equipped with the modified suction means shown in FIG. 7.

The suction nozzle 12 is mounted on a carrier member 13 provided with rollers 14 which are capable of running along the corresponding rails mounted on the suction duct 11 as shown in FIG. 4. The carrier member 13 is displaced by a driving means comprising a driving pulley 20, which is driven by a motor (not shown), and an endless belt 15 which is disposed along the passage of the carrier member 13 and turnably held by the driving pulley 20 and a guide pulley (not shown in FIG. 3) mounted on an outend frame (not shown) of the spinning machine A. In the modified embodiment of the apparatus according to the present invention in FIGS. 7 and 8, the above-mentioned driving means is modified in such a way that the driving pulley 20 and the guide pulley 20*a* are secured to the corresponding vertical shafts 28, 28*a*, respectively. The vertical shaft 28 is driven by a motor (not shown) while the vertical shaft 28*a* is turnably mounted on the outer frame B*a* as shown in FIG. 7. In this embodiment the endless belt 15 is disposed above the suction duct 11.

In the two embodiments shown in FIGS. 3 and 4, FIGS. 7 and 8 the duct 11 is provided with a longitudinal horizontal aperture formed in the top wall of the duct 11 along the length of the machine and a suction nozzle 12 for holding a yarn end in the doffing and donning operation is mounted by way of a connecting pipe 12*a* on the carrier member 13 which travels along the machine frame. The connecting pipe 12*a* connected to the suction nozzle 12 is inserted into the duct 11 through a space between the skirt portion of the flexible covering plate 11*a* and an edge of the aperture of the duct 11 as shown in FIG. 4. Therefore, the connecting pipe 12*a* is connected to the duct 11 in a displaceable condition. The connecting pipe 12*a* is rigidly mounted on the carrier member 13 by a bracket 13*a*. The end portion of the pipe 12*a* is expanded so that the transverse cross section of the duct 11 is occupied by the end portion of the pipe 12*a*. Therefore, the suction force created by the suction blower 19 is effectively transmitted to the connecting pipe 12*a*.

Figure 5:
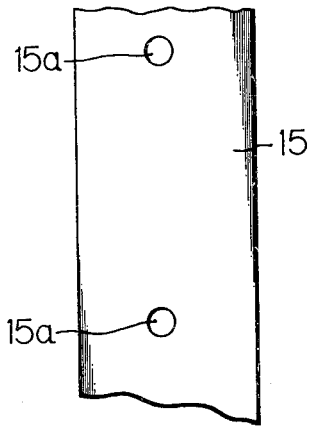
FIG. 5 is a plan view of a belt utilized for the suction means shown in FIG. 4.

Referring to FIGS. 4 and 5, the carrier member 13 is detachably engaged with the endless belt 15 by way of an engaging member 16, so that the carrier member 13 holding the suction nozzle 12 is capable of displacement along the machine and can stop temporarily in front of a take-up mechanism of any spinning unit. The engaging member 16 is provided with a pin 16*a* for engaging the carrier member 13 with the belt 15. The belt 15 is provided with a plurality of apertures 15*a*, any one of which is capable of accepting the pin 16*a*. The pin 16*a* is always urged toward the belt 15 by an expansion spring 16*b* in order to maintain the engagement of the carrier member 13 with the belt 15; however, if it is necessary to stop the carrier member 13 at a position in front of any given take-up mechanism of a spinning unit, the engagement of the pin 16*a* with the belt 15 can be released by a manual control means comprising a guide member 24 and an operation handle 21 mounted respectively on each suction nozzle 12, and an operation wire 22 which connects a top end portion 23 of the pin 16*a* and the operation handle 21 by way of the guide member 24. In other words, when the wire 22 is pulled by the operation handle 21, the pin 16*a* is pulled from the belt 15, releasing the engagement of the pin 16*a* with the aperture 15*a* of the belt 15. In the above-mentioned embodiment, a safety device (not shown) which prevents simultaneous actuation of the engaging member 16 by both operation handles 21, is mounted on the carrier member 13.

Figure 6:
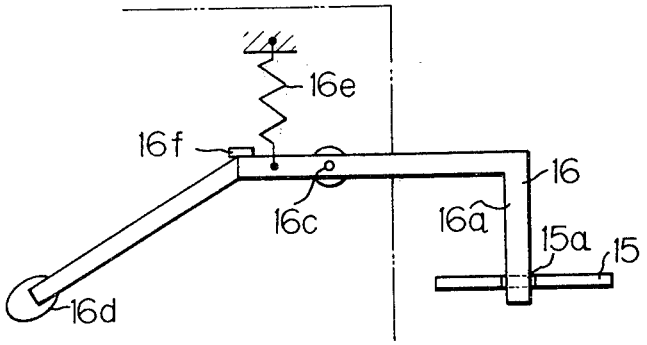
FIG. 6 is a schematic side view of a modified engaging means of the suction means shown in FIG. 4.

Another embodiment of the engaging member 16 is shown in FIG. 6. In this embodiment, the engaging member 16 comprises an L shaped pin 16*a* turnably mounted on the carrier member 13 (not indicated in FIG. 6) by a pin 16*c*. A handle 16*d* is rigidly connected to a free end of the L shaped pin 16 so as to turn the pin 16 about the pin 16*c* for engaging or disengaging the pin 16 into or from the aperture 15*a* of the belt 15. A helical spring 16*e* is mounted on the carrier member 13 in such a way that the L shaped pin 16*a* is always pulled so as to maintain the engagement into the aperture 15*a* of the belt 15, as shown in FIG. 6. A stopper 16*f* mounted to the carrier member 13 prevents any excess insertion of the pin 16*a* into the aperture 15*a* of the belt 15.

Figure 2A:
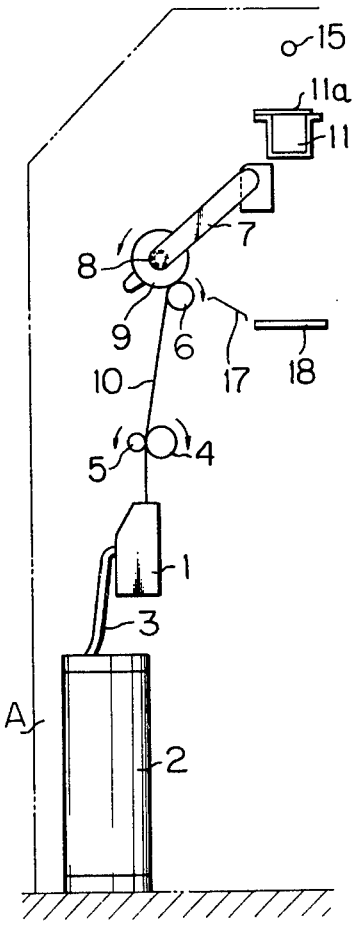
FIGS. 2A, 2B, 2C and 2D are schematic side views of an improved apparatus for carrying out the doffing and donning operation, showing steps of a doffing and donning operation, according to the present invention.
Figure 2B:
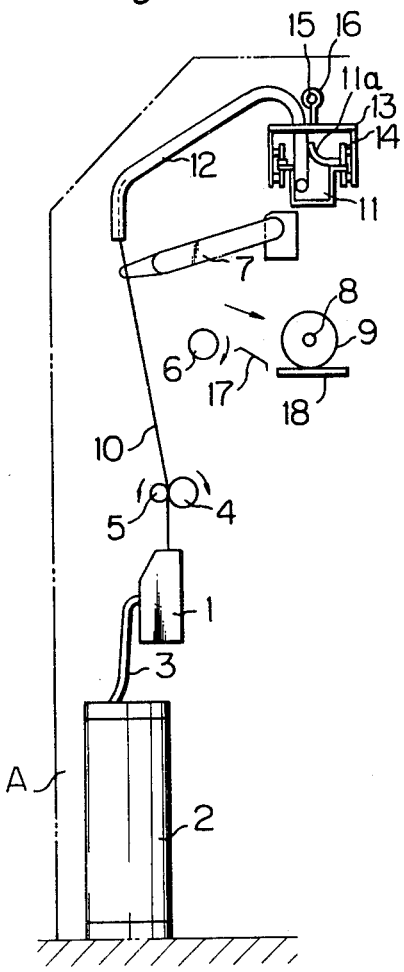

Next, the operation of the above-mentioned apparatus shown in FIGS. 3 and 4 is hereinafter explained. The carrier member 13 and the suction nozzle 12 are reserved at a position outside the spinning unit 1, as indicated by a dash-dot line in FIG. 3. During the normal spinning operation, the suction blower 19 and a motor for driving the driving pulley 20 are also stopped. When the size of yarn packages formed by the respective take-up mechanisms become the predetermined full size, as shown in FIG. 2A an electrical means (not shown) for actuating the suction blower 19 and the motor for driving the driving pulley 20 are actuated manually or by a signal issued from an automatic counter (not shown). An operator for carrying out the doffing and donning operation cuts the yarn between each full size yarn package on each take-up mechanism and the corresponding spinning unit 1 and carries a leading end of the yarn delivered from the spinning unit 1 to the mouth of the suction nozzle 12 so that the leading end of the yarn is sucked into the suction nozzle 12. When the cut end portion of the yarn is wound on the yarn package 9, the cradle 7 is turned toward the suction nozzle 12, while the full size yarn package 9 is doffed from the cradle 7 and displaced to the conveyer belt 18 (FIG. 2B).

Figure 2C:
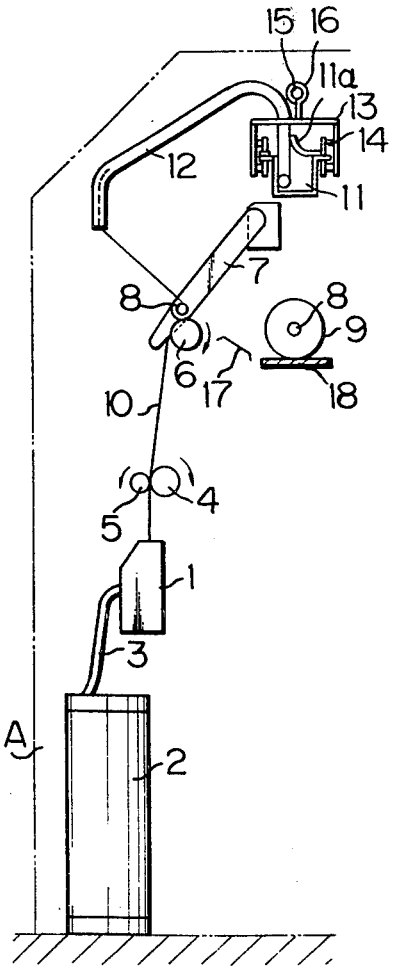

Next, the yarn held by the suction nozzle 12 is engaged by a fresh bobbin 8 mounted on the cradle 7 and then the cradle 7 is turned toward the split drum 6 so as to contact the bobbin 8 thereto. (FIG. 2C). The above-mentioned donning operation is carried out manually.

Figure 2D:
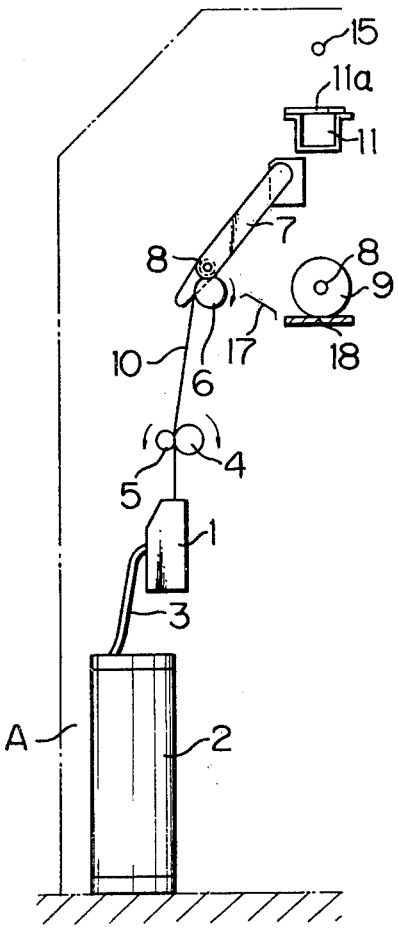

Then, the yarn extending from the fresh bobbin 8 to the suction nozzle 12 is severed and, therefore, the cut end portion of the yarn which is separated from the yarn held by the suction nozzle 12 is wound on the fresh bobbin 8. According to the above-mentioned operation, the cut portion of the yarn held by the suction nozzle 12 is sucked into the nozzle 12 and carried to a terminal of the suction duct 11, where it and other similar portions are accumulated as waste. In this condition, the normal take-up operation of yarn 10 by the take-up mechanism is commenced. (FIG. 2D).

In the above-mentioned embodiments of the apparatus according to the present invention, the driving speed of the endless belt 15 is selected so as to displace the carrying member 13 a unit distance of one spinning unit 1 during the time required to carry out the doffing and donning operation for a spinning unit 1. This driving speed may be changed so as to fit the skill of the operator. Since the above-mentioned time for carrying out the doffing and donning operation is independent of the delivery speed of the spinning unit, the operation can be carried out in the best condition for the operator. In addition, if unexpected troubles occur, the carrying member 13 can be stopped by easy manual operation of the operation handle 21 (FIG. 4) or 16*d* (FIG. 6).

Since the carrying passage of the mouth of the suction nozzle 12 is outside the spinning unit with respect to the take-up mechanism, the mounting operation of the fresh bobbin 8 on the cradle 7 can be easily carried out as mentioned above. (FIG. 2C). To carry out the donning operation more easily than in the above-mentioned embodiment, an automatic yarn cutter, and/or yarn guide means may be utilized with the apparatus according to the present invention. Further, the above-mentioned suction blower 19 may be mounted on the carrying member 13 instead of utilizing the suction blower 19 stationarily disposed to a gear end frame of the spinning machine and the suction duct 11.

What is claimed is:

1. In an apparatus for carrying out doffing and donning operations at each unit of a spinning machine, means for continuously delivering a yarn from said spinning unit, and a take-up mechanism provided with a friction roller and a cradle for rotatably supporting a fresh bobbin or a yarn package formed on said bobbin in contacting relationship with said friction roller, said cradle being pivotally supported on a shaft mounted on a bracket secured to a frame of said units, means for releasably and rotatably holding a bobbin on said cradle, said holding means being disposed on said cradle, suction means disposed at a position on the opposite side of said delivery means with respect to said friction roller for temporarily forming a yarn passage by a yarn continuously being delivered from said delivery means at a position in front of the part of the peripheral surface of said friction roller where said yarn passes over during a normal taking up operation, the improvement comprising means for displacing said suction means in a direction lengthwise of said spinning machine to a position outside and above said take-up mechanism of each spinning unit at the time of doffing and donning operations, and means for creating suction force in said suction means, said displacing means comprising means for temporarily stopping said suction means at any point lengthwise of said spinning units, said suction means comprising a suction nozzle provided with a mouth opened at a position outside and above any of said take-up mechanisms and a connecting pipe connected to said suction force creating means, said suction force creating means comprising a suction blower disposed at a gear end frame or an outer frame of said spinning machine and a horizontal suction duct extending in a lengthwise direction of said spinning machine at a position above said take-up mechanisms, said suction duct being connected to said suction blower and having an elongated aperture extending in the lengthwise direction of said machine and covered with a flexible plate, said connecting pipe of said suction nozzle displaceably extending into said duct through said aperture, in a condition such that said flexible cover plate seals said aperture of said suction duct other than at the portion of said aperture through which said connecting pipe of said suction nozzle extends, said displacing means comprising an endless belt extending lengthwise of said spinning machine at a position above said take-up mechanisms, and driving pulley and a guide pulley respectively disposed at the end frames of said spinning machine, and a motor for driving said driving pulley, said endless belt being held by said pulleys, a guide rail means disposed along said suction duct, a carrying member displaceably mounted on said guide rail, and an engaging member for detachably engaging said endless belt with said carrying member, said connecting pipe being held by said carrying member for movement lengthwise of said machine.

2. An improved apparatus for carrying out the doffing and donning operation according to claim 1, further comprising an actuating means for selectively engaging and disengaging said engaging member with said endless belt, said actuating means being provided with a manually operable handle.

3. The apparatus of claim 2 wherein said manually operable handle is mounted on said suction means, said actuating means further comprising wire means extending between said manually operable handle and said engaging member.

* * * * *

UNITED STATES PATENT OFFICE

CERTIFICATE OF CORRECTION

Patent No. 4,006,864 Dated February 8, 1977

Inventor(s) Takuzo Tooka

It is certified that error appears in the above-identified patent and that said Letters Patent are hereby corrected as shown below:

Column 4, line 9: "is" (second occurrence) should be --as--.

line 23: "Aligned raw" should be --aligned row--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*